United States Patent [19]

Wetty

[11] Patent Number: 4,846,042

[45] Date of Patent: Jul. 11, 1989

[54] TOOL HANDLE WITH A ROTATABLE CAP

[76] Inventor: W. Les Wetty, 244 Shoemaker Rd., Pottstown, Pa. 19464

[21] Appl. No.: 231,354

[22] Filed: Aug. 11, 1988

[51] Int. Cl.[4] ..... B25G 1/08

[52] U.S. Cl. ..... 81/490; 81/177.1; 16/110 R

[58] Field of Search ..... 81/177.1, 490; 16/110 R

[56] References Cited

U.S. PATENT DOCUMENTS

| | | | |
|---|---|---|---|
| 1,772,040 | 8/1930 | Dunlea | 81/177.1 |
| 2,707,784 | 5/1955 | Erdos | 81/177.1 X |
| 3,343,577 | 9/1967 | Wagner | 81/177.1 |
| 4,117,568 | 10/1978 | Bullock | 16/110 R |
| 4,300,607 | 11/1981 | Mellinger | 81/490 |
| 4,653,356 | 3/1987 | Golden | 81/490 X |

*Primary Examiner*—James G. Smith

*Attorney, Agent, or Firm*—Allegretti & Witcoff, Ltd.

[57] ABSTRACT

A tool handle includes an elongated body having a cap thereon rotatable with respect to body to facilitate use by reducing friction to the hand of the user upon rotation of the handle carrying a tool, such as a screwdriver. The cap has a projection or flange adapted to engage in snap fit relationship with a locking recess on the exterior of the body to hold the cap on the body. In another embodiment, the body is hollow and has an internal chamber for receiving tools. The rotatable cap has an opening adapted to be closed by a top that is secured to the cap by a live hinge. In a further embodiment, the cap and body are provided with interengaging means which are cammed apart during relative rotation of the cap with respect to the body to enable release of the cap from the body to permit access to the tool or tools in the internal chamber.

7 Claims, 2 Drawing Sheets

TOOL HANDLE WITH A ROTATABLE CAP

BACKGROUND OF THE PRESENT INVENTION

This invention relates to a tool handle, and more particularly to an ergometically-styled handle for receiving tools, such as screwdrivers or wrenches, which tool handle has a unique cap thereon.

Tool handles for screwdrivers or the like tools generally have a solid body. The body is sometimes hollow to receive tool bits, e.g., screwdriver ends. In use there is often considerable friction between the hand of the user and the exterior of the tool handle. Thus, one feature of the present invention is to provide a rotatable cap on the end of the tool handle for substantially reducing the undesired friction between the hand of the user and the tool handle.

There is known in the prior art tool handles having lids or covers for retaining tools in a hollow chamber in the tool handle, however, none suggest the rotatable cap for a solid or hollow tool handle and none suggest the hollow handle and cap of the present invention. Buell, 267,060, shows a tool handle having an end plate rotatably secured to the handle for opening and closing a hollow chamber in the handle. Robertson, in U.S. Pat. No. 3,426,813, reveals a somewhat similar arrangement insofar as the arrangement for securing the lid 16 to the handle 10 is concerned. Hood, in U.S. Pat. No. 1,587,647, shows a handle with a chamber closed by a plug 12. Corona, in U.S. Pat. No. 4,716,795, discloses a tool handle having an opening herein closed by cap 20. None of these references suggest the present invention.

There is also known in the prior art a tool handle that is segmented (for example, Mellinger, in U.S. Pat. No. 4,300,607), but such patent does not suggest the unique handle and cap arrangement described herein.

Also known in the prior art are closures for containers having a live hinge. See, for example, Paull, U.S. Pat. No. 2,630,239; Uhlig, U.S. Pat. No. 4,257,537; Lewis, U.S. Pat. No. 4,280,636; and Roberto, U.S. Pat. No. 4,386,714. However, none of these closures are associated with a tool handle or are suggestive of the present invention, which includes a cap on the tool handle rotatable relative thereto to reduce friction between the hand of the user and the tool handle during use of the tool handle.

An object of the present invention is to provide an improved tool handle wherein the disadvantages and deficiencies of prior tool handles are obviated.

Another object of the present invention is to provide a tool handle with a cap that is rotatable relative to the body so as to reduce friction between the hand of the user and the tool handle during use of the tool handle.

A further object of the present invention is to provide a tool handle which has a hollow body with a cap having projections thereon engaging a recess on the exterior surface of the hollow body in snap-fit relationship for securing the cap to the elongated body so as to retain a tool or tools in the internal chamber in the hollow body.

Still another object of the present invention is to provide an ergometrically-styled tool handle with a hollow body and a cap that is rotatably secured to the body so as to provide for reduced friction to the hand of the user upon rotation of the handle carrying the tool.

Another object of the present invention is to provide a tool handle with a hollow body having an internal chamber for receiving and storing tools, the internal chamber within the hollow body being closed by a cap which is detachably snap fit to the top of the hollow body so as to permit release of the cap from the body to permit access to the internal chamber.

Yet another object of the present invention is to provide a tool handle with a hollow body closed by a rotatable cap which has a top secured thereto by a live hinge for closing the opening in the cap. Other objects and advantages of the present invention will become more apparent from the following description.

DETAILED DESCRIPTION OF THE DRAWING

There is shown in the attached drawing a presently preferred embodiment of the present invention wherein like numbers in the various views refer to like elements and wherein.

DETAILED DESCRIPTION OF THE PRESENT INVENTION

Figure 1:
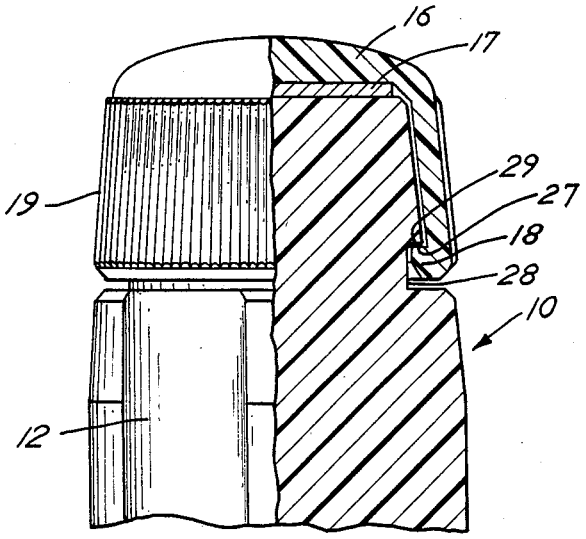
FIG. 1 is a cross-sectional view, with parts broken away, of a first embodiment of tool handle having a rotatable end cap on the tool handle.

Referring to FIG. 1, there is shown a first embodiment of the invention where the cap may be permanently secured in rotatable engagement with the body of the tool handle. The tool handle 10 comprises a solid elongated body 12 and a cap 16 rotatably joined to the body 12. The cap 16 is provided with sidewalls having a continuous inwardly extending flange 18 which is adapted to engage in snap fit relationship within an annular recess or locking groove 28 on the exterior of the body 12. The cap 16 is provided with knurling or longitudinally extending ribs 19 on the exterior surface in order to facilitate turning or rotation of the cap 16 on the body 12. The top surface 27 of the flange 18 is adapted to engage the surface 29 of the recess 28 in order to hold the cap 16 onto the body 12. A friction washer 17 is disposed between the cap 16 and the body 12 to facilitate rotation of the cap 16 relative to the body 12.

The cap 16 and body 12 are preferably fabricated from plastic that is tough and durable for the intended uses, yet will have sufficient resiliency to provide for snap-fit engagement of flange 18 of cap 16 into the annular recess or locking groove 28. Examples of suitable plastics are polypropylene, which is preferred, polystyrene or cellulose acetate.

The end cap 16 is rotatable relative to the body 12 so that in use, for example with a screwdriver, when the user reaches the limit of rotation, i.e., when the screw is seated, the cap 16 may continue to rotate relative to the body 12 to prevent abrasion of the hand of the user. The tool handle is ergometrically styled and thereby enhances use of the screwdriver or like implement that is affixed to the tool handle.

Figure 2:
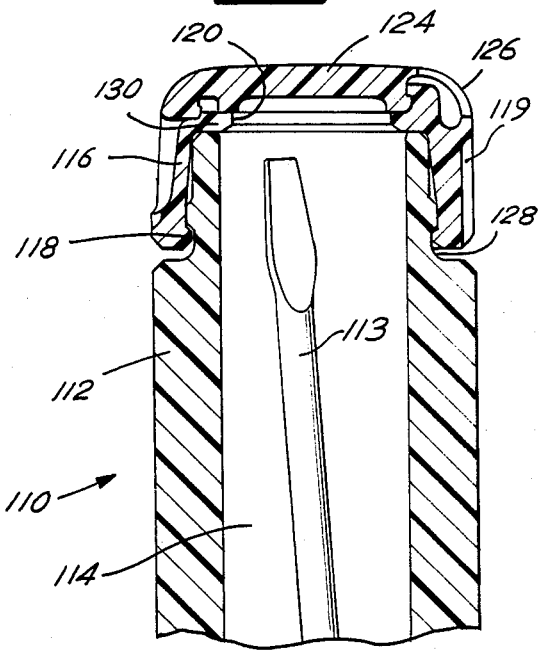
FIG. 2 is a cross-sectional view of a second embodiment of tool handle, which includes a rotatable end cap having an opening closed by a top secured to the cap by a live hinge.
Figure 4:
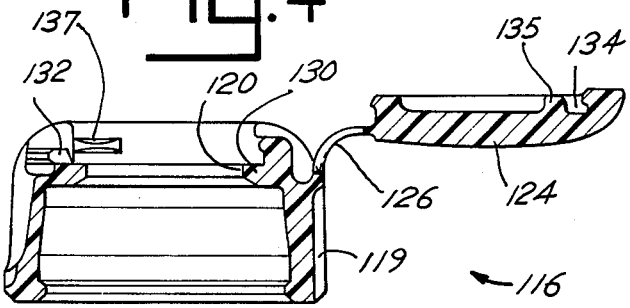
FIG. 4 is a cross-sectional view of the cap of FIGS. 2 and 3 with the top in the open position.
Figure 3:
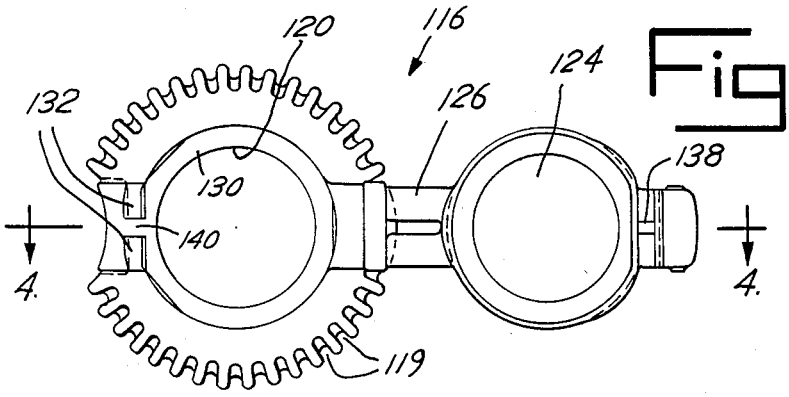
FIG. 3 is a plan view of the cap of FIG. 2.
Figure 5:
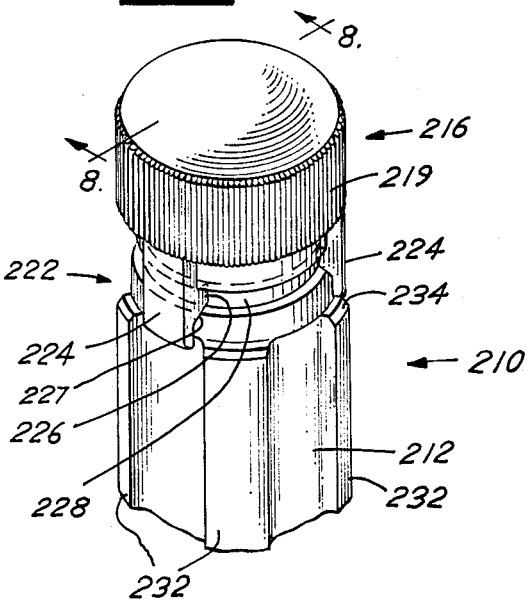
FIG. 5 is a perspective view of a third embodiment of tool handle which incorporates a cap that is detachably secured to the tool handle body by relative rotation between the cap and the tool handle body.
Figure 7:
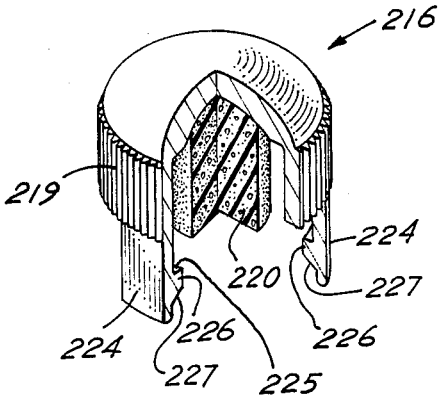
FIG. 7 is a perspective of the cap of FIG. 5 with parts broken away for clarity.
Figure 8:
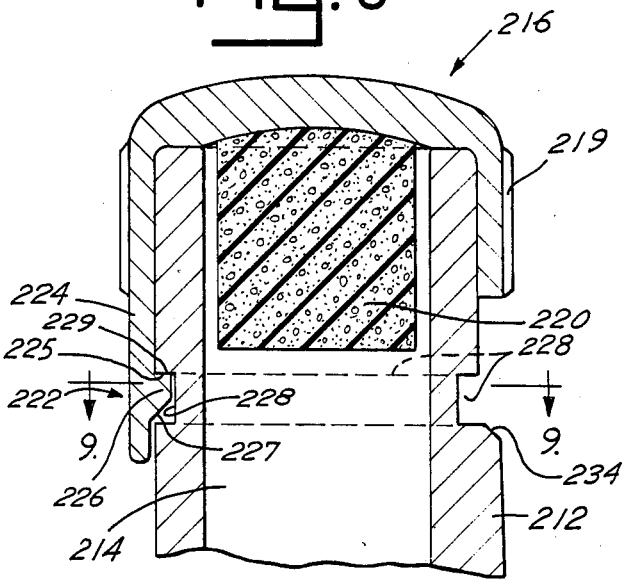
FIG. 8 is a cross-sectional view of the cap and tool handle body taken generally along the line 8—8 of FIG. 5.
Figure 6:
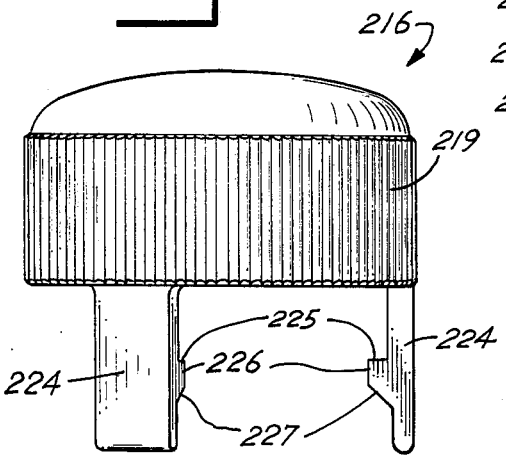
FIG. 6 is a side view of the cap of FIG. 5.

There is shown in FIGS. 2, 3 and 4 a further embodiment of the present invention wherein the elongated body is hollow and the cap for closing the top of the elongated hollow body is provided with a top secured thereto by a live hinge. The tool handle 110 comprises a hollow elongated body 112 having an internal chamber 114 therein adapted to receive tools, such as screwdrivers or socket ends. A screwdriver end or tip 113 is shown in chamber 14 in FIG. 2. The open end of chamber 114 is closed by a cap 116, which is rotatably retained on the body 112 in a manner substantially the same as cap 16 is secured to body 12 in the embodiment of FIG. 1. The cap 116 has side walls having a continuous or substantially continuous inwardly extending flange 118, which is adapted to engage within an annular recess 128 in the body 112. The cap 116 is provided with knurling or longitudinal ridges and grooves 119 to enhance gripping of the tool handle by the user.

The body 112 is elongated and hollowed or cored so as to define an internal chamber 114 for receiving and storing tools such as screwdriver ends. The body 112 may be fabricated from a suitable plastic, as described above, for example, cellulose acetate.

The cap 116 has an opening 120 formed herein as to permit access to the chamber 114 when the cap 116 is mounted on the body 112. The opening 120 is closed by a top 124 that is connected to the cap 116 by a live hinge 126. The cap 116 and top 124 are preferably integrally molded from plastic such as polypropylene. The live hinge 126 is formed by a relatively thin section which will permanently retain the top 124 attached to the cap 116, even when the top 124 is open.

The flange 130 of cap 116, within which opening 120 is formed has a male member or catch 132 at one side thereof opposite the live hinge 126. A female member or recess 134 in the top 124, which is complementary in configuration to the catch 132 cooperates with the catch 132 and defines complementary interengaging means for holding the top 124 in closed position on cap 116, while providing selective opening of the top when desired. The recess 134 may have a rib 138 therein for reinforcement purposes. If there is a rib 138 on the top 124, then the catch 132 is recessed as indicated at 140 (FIG. 3) to accommodate the rib 138. Additional cooperating means for retaining the top 124 in closed position include latch 135 on the top 124 and retainer 137 on the cap.

The cap 116 is preferably cut back or is concave in the region 142 where the edge of top 124 overlaps the catch 132. This is done to enable the user to more readily reach the edge 136 and disengage the male catch or latch 132 and female recess 134 so as to open 124.

In use, the cap 116 is positioned over the tool handle body 112 end pushed downwardly until the flange 118 is snap fit into the annular recess 128. The cap 116 is thereby rotatably secured to the body 112. Top 124 may be flipped open to permit access to the internal chamber 114 in hollow body 112. Screwdriver bits or like tools may be stored in the hollow chamber 114. A foam member (not shown in the embodiment of FIGS. 2–4, but shown in the embodiment of FIGS. 5-9) may be used to help prevent rattle of the tools in chamber 214.

The top 124 is closed by moving the top 124 about hinge 126 to engage the catch 132 on the cap 116 within the recess 134 on the top 124.

Since the cap 116 is rotatable with respect to the body 112, when the user reaches a stop during normal use, for example, when a screw is seated, the cap 116 may continue to rotate relative to the body 112 and thus prevent friction between the tool handle and palm of the user in the region of the cap 116.

With reference to FIGS. 5–9, there is shown a third embodiment of the present invention. The tool handle 210 comprises a hollow elongated body 212 which include an internal chamber 214 therein adapted to receive tools, for example, screwdrivers or socket ends. The screwdriver or like tool may be detachably secured to the bottom of the tool handle 10 in conventional fashion. The side of the cap 216 is knurled or ridged and grooved as shown at 219 in order to enhance gripping thereof by the user. A foam rubber pad 220 is provided within the cap 216 in order to help cushion the tools retained within the internal chamber 214 and prevent rattling. The foam rubber pad 220 is secured to the cap by suitable means as, for example, an adhesive.

Complementary means 222 are provided in order to secure the cap 216 detachably to the body 212. The complementary interengaging means include depending tabs 224 which have inwardly extending projections 226 thereon. The inwardly extending projections 226 engage within an annular recess or locking groove 228 on the exterior of the body 212. The cap 216 is preferably formed of plastic as described above so that the depending members 224 have resiliency and can yield with respect to the body. In use, the cap 216 is urged downwardly over the top of the elongated hollow body until the projections 226 are seated in snapfit relationship in the annular recess 228. The top surface 225 of the projection 226 engages the upper surface 229 of the recess 228 to retain the cap 216 on the body 212.

Ribs 232 are provided on the exterior of the body 212. In one embodiment shown there are three depending tabs 224 and six ribs 332. The ribs 232 are provided on the top thereof with angled cam surfaces 234. The tabs 224 are each provided with a cam follower 227 below the projection 226. Upon rotation of the caps 216 relative to the body 212, the cam follower 227 of the lug or tab 224 will engage the angled surface 234 at the top of the rib and cause a camming on or movement of the tab 224 outwardly from the body 212. Each projection 226 will be disengaged from the annular recess 228, and the cap 216 may then be removed from the body 212 so as to provide access to the internal chamber 214.

Figure 9:
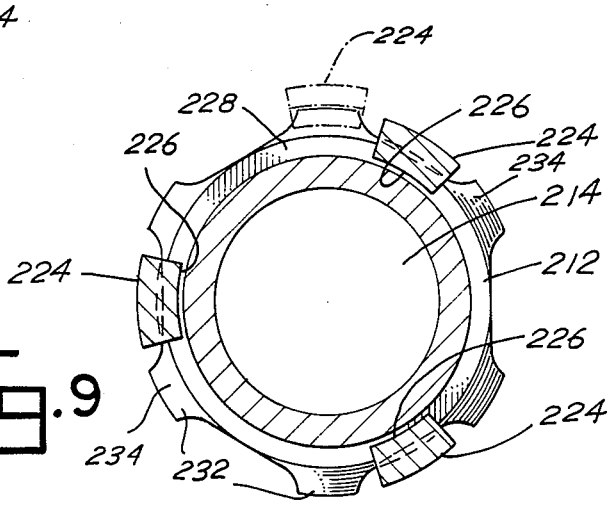
FIG. 9 is across-sectional view of the cap and tool handle body taken generally along the line 9—9 of FIG. 8.

FIG. 9 shows the tabs 224 in solid line in the position in engagement with the annular recess 228. One tab is shown in dotted line, which is the position of the tab 224, with projection 226 disengaged from the annular recess 28.

While I have shown presently preferred embodiments of the present invention, it will be understood by those skilled in the art that variations may be made thereto in using the invention, without departing from the scope of the invention defined by the appended claims.

What is claimed:

1. A tool handle comprising an elongated body having an annular locking recess on the exterior surface thereof, a cap having an internally extending projection engaging the recess in snap fit relationship for rotatably securing the cap on the body, said body being hollow and having a chamber therein adapted to receive tools, the cap having an opening therein for providing access to the chamber and a top mounted on the cap to open and close said opening, to permit access to the chamber, whereby in use the cap may rotate relative to the body to reduce possible friction between the body and the hand of the user.

2. A tool handle as in claim 3 including cushioning means provided within the cap to help cushion the tools in said chamber and prevent rattling.

3. A tool handle comprising an elongated body and having an annular recess on the exterior surface thereof, a cap having at least one internally extending projection engaging the recess in a snap fit relationship for securing the cap to the elongated body, said cap being rotatable with respect to said body, said cap having an opening therein and a top secured to the cap by an integral live-hinge for selectively opening and closing said opening in the cap.

4. A tool handle as in claim 3 wherein the cap and top are molded from plastic and the hinge is relatively thin in cross-section as compared to the cap and top.

5. A tool handle as in claim 4 wherein the cap and the top are provided with complementary interengaging means for detachably locking the cap and the top, the complementary interengaging means being disengaged for opening the top and permitting access to the internal chamber.

6. A tool handle as in claim 5 wherein the complementary interengaging means include a female member on the top and a male member on the cap.

7. A tool member as in claim 5 wherein the complementary interengaging means includes a latch on the cap and a recess in the top.

* * * * *